US011008854B2

(12) United States Patent
Oliphant et al.

(10) Patent No.: US 11,008,854 B2
(45) Date of Patent: May 18, 2021

(54) APPARATUS AND METHOD FOR DOWNHOLE DATA ACQUISITION AND OR MONITORING

(71) Applicant: Weatherford U.K. Limited, Leicestershire (GB)

(72) Inventors: Martin Oliphant, Aberdeenshire (GB); Keith Adams, Aberdeenshire (GB)

(73) Assignee: Weatherford U.K. Limited, Leicestershire (GB)

( * ) Notice: Subject to any disclaimer, the term of this patent is extended or adjusted under 35 U.S.C. 154(b) by 0 days.

(21) Appl. No.: 16/316,544

(22) PCT Filed: Jul. 18, 2017

(86) PCT No.: PCT/GB2017/052112
§ 371 (c)(1),
(2) Date: Jan. 9, 2019

(87) PCT Pub. No.: WO2018/015739
PCT Pub. Date: Jan. 25, 2018

(65) Prior Publication Data

US 2019/0301275 A1 Oct. 3, 2019

(30) Foreign Application Priority Data

Jul. 18, 2016 (GB) ..... 1612396

(51) Int. Cl.
*E21B 34/02* (2006.01)
*E21B 47/135* (2012.01)
(Continued)

(52) U.S. Cl.
CPC ..... *E21B 47/085* (2020.05); *E21B 23/01* (2013.01); *E21B 34/10* (2013.01); *E21B 34/105* (2013.01); *E21B 47/12* (2013.01); *E21B 2200/05* (2020.05)

(58) Field of Classification Search
CPC ..... E21B 34/00; E21B 34/16; E21B 47/01; E21B 47/135; E21B 220/05; E21B 34/02; E21B 23/01; E21B 2200/05
See application file for complete search history.

(56) References Cited

U.S. PATENT DOCUMENTS 6,531,694 B2 3/2003 Tubel et al.
6,532,839 B1 3/2003 Kluth et al.
(Continued)

FOREIGN PATENT DOCUMENTS

GB 2504104 A 1/2014
WO 2006/034214 A2 3/2006
(Continued)

OTHER PUBLICATIONS

Int'l Search Report and Written Opinion in counterpart PCT Appl. PCT/GB2017/052112, dated Oct. 20, 2017, 10-pgs.
(Continued)

*Primary Examiner* — Kenneth L Thompson
(74) *Attorney, Agent, or Firm* — Blank Rome LLP

(57) ABSTRACT

An apparatus (10) for downhole data acquisition and/or monitoring is configured to be disposed within a completion (12) and comprises a hanger (36) configured to latch into a control line spool (38), a retrofit valve (40) for location within the subsurface safety valve (16) of the completion (12), and a sensing arrangement (42) including an optical fiber line (44). In use, the apparatus (10) is configured to be run into the completion (12) and is operable to provide data acquisition and/or monitoring capability in the well, including up or near total depth and in particular but not exclusively in the region of the well subjected to an intervention operation, such as a chemical injection operation.

20 Claims, 9 Drawing Sheets

(51) Int. Cl.

| | |
|---|---|
| ***E21B 47/085*** | (2012.01) |
| ***E21B 23/01*** | (2006.01) |
| ***E21B 34/10*** | (2006.01) |
| ***E21B 47/12*** | (2012.01) |

(56) References Cited

U.S. PATENT DOCUMENTS

| | | | | |
|---|---|---|---|---|
| 6,557,630 | B2 | 5/2003 | Harkins et al. | |
| 6,787,758 | B2 | 9/2004 | Tubel et al. | |
| 6,828,547 | B2 | 12/2004 | Tubel et al. | |
| 6,913,079 | B2 | 7/2005 | Tubel | |
| 7,000,696 | B2 | 2/2006 | Harkins | |
| 7,013,970 | B2 * | 3/2006 | Collie | E21B 29/08 166/89.1 |
| 7,773,841 | B2 | 8/2010 | Varadarajan et al. | |
| 7,823,648 | B2 * | 11/2010 | Bolding | E21B 43/25 166/375 |
| 7,886,830 | B2 * | 2/2011 | Bolding | E21B 34/106 166/322 |
| 7,946,341 | B2 | 5/2011 | Hartog et al. | |
| 8,040,250 | B2 | 10/2011 | Ramos | |
| 8,087,461 | B2 * | 1/2012 | Fitzgerald | E21B 23/14 166/107 |
| 8,225,867 | B2 | 7/2012 | Hartog et al. | |
| 8,274,400 | B2 | 9/2012 | Wilson et al. | |
| 8,630,816 | B2 | 1/2014 | Park et al. | |
| 8,925,631 | B2 | 1/2015 | Patel | |
| 2011/0162839 | A1 | 7/2011 | Hansen | |
| 2012/0031494 | A1 | 2/2012 | Lymberopoulos | |
| 2015/0068769 | A1 | 3/2015 | Xiao et al. | |
| 2015/0354308 | A1 | 12/2015 | June et al. | |

FOREIGN PATENT DOCUMENTS

| | | | |
|---|---|---|---|
| WO | 2006/041811 | A2 | 4/2006 |
| WO | 2006/069247 | A2 | 6/2006 |

OTHER PUBLICATIONS

Combined Search and Examination Report in counterpart GB Appl. GB1612396.0, dated May 30, 2017, 5-pgs.

Examination Report in counterpart GB Appl. GB1612396.0, dated May 11, 2020, 2-pgs.

* cited by examiner

APPARATUS AND METHOD FOR DOWNHOLE DATA ACQUISITION AND OR MONITORING

CROSS-REFERENCE TO RELATED APPLICATIONS

This is a 371 application of PCT Appl. No. PCT/GB2017/052112 filed 18 Jul. 2017, which is incorporated herein by reference in its entirety.

FIELD

The subject matter of the present disclosure relates to an apparatus and method for downhole data acquisition and/or monitoring.

BACKGROUND

In the oil and gas exploration and production industry, wells are drilled to access subsurface hydrocarbon-bearing rock formations, the well boreholes typically then being lined with sections of bore-lining tubing. Once the well has been completed, hydrocarbons are permitted to flow from the formation to surface.

Production of hydrocarbons from a given formation may vary over the operational life of a well. For example, in some instances production may be inhibited by increasing volumes of water entering the well, known as "liquid loading." Liquid loading can amongst other things result in intermittent flow, an increase in hydrostatic pressure and reduced production flow rates. In more extreme cases, the water ingress may be sufficient to "kill" the well.

In order to stimulate, or in some cases re-establish, production from a well it may be necessary or desirable to perform an intervention operation or workover operation. In the case of liquid loading, for example, one such intervention operation involves a chemical treatment whereby a foaming agent is injected into the formation.

While such intervention operations have been effective in increasing production, there are a number of challenges with conventional equipment and techniques. For example, in the case of chemical treatment of a well, the chemicals used in the treatment, e.g. foaming agents, are expensive and it can be difficult to predict the exact quantities of the treatment chemical required to optimize the intervention. Moreover, the effectiveness of a given intervention operation may be difficult to determine.

SUMMARY

According to a first aspect, there is provided an apparatus for downhole data acquisition and/or monitoring, the apparatus comprising: a valve device adapted to be run into a borehole; and a conveyance for conveying the valve device into and/or from the borehole, the conveyance comprising a sensing arrangement including an optical fiber for providing downhole data acquisition and/or monitoring in the borehole, wherein the sensing arrangement is disposed through a body of the valve device and extends beyond the valve device into the borehole.

The valve device may comprise: a body; an axial flow passage; and a valve member for permitting selective access through the axial flow passage of the valve device, wherein the valve device is configurable between an open configuration in which the valve member permits passage of fluid through the axial flow passage of the valve device and a closed configuration.

In use; the valve device may be run into a borehole, in particular an existing completion, completion string or the like, and may be operable to provide downhole data acquisition and/or monitoring in the borehole.

Embodiments of the present disclosure provide a number of benefits.

For example, embodiments of the present disclosure may facilitate downhole data acquisition and/or monitoring while maintaining full well control capability, since operation of the sensing arrangement is unaffected by the configuration of the valve device; in contrast to conventional data acquisition and/or monitoring techniques which require the completion system safety control valve to be open in order to permit monitoring systems to be run into the borehole.

Embodiments of the present disclosure may permit data acquisition relating to a formation and/or reservoir at a downhole location or locations—e.g. at the point of injection of a chemical treatment—which is otherwise not possible with conventional techniques and equipment.

The data may be obtained in real time, permitting an operator to improve the efficiency and/or efficacy of an intervention operation—e.g. by permitting an operator to optimize the quantity and/or composition of treatment fluid in a chemical treatment.

Embodiments of the present disclosure provide a retrofittable permanent or semi-permanent system for oil and gas reservoir monitoring. Embodiments of the present disclosure may thus be maintained in place during subsequent operations, reducing downtime which may be otherwise be associated with conventional techniques requiring data acquisition runs into the borehole.

As described above, the apparatus is operable to provide downhole data acquisition and/or monitoring in the borehole.

The apparatus may for example be configured to acquire data relating to temperature in the borehole.

Alternatively, or additionally, the apparatus may be configured to acquire data relating to pressure in the borehole.

The apparatus may be configured to acquire data in order to provide a profile of the borehole. For example, the apparatus may be configured to provide Distributed Temperature Sensing (DTS) and/or Distributed Acoustic Sensing (DAS) in the borehole. In use, Distributed Temperature Sensing (DTS) and/or Distributed Acoustic Sensing (DAS) data may be obtained by analysis of the changes in light transmission through the optical fiber of the sensing arrangement; irrespective of the configuration of the valve device.

The sensing arrangement may comprise a single optical fiber.

In particular embodiments, the sensing arrangement may comprise a plurality of optical fibers. The plurality of optical fibers may be housed within the conveyance.

The optical fiber, or in embodiments comprising a plurality of optical fibers at least one of the optical fibers, may terminate at the downhole location.

Alternatively, the optical fiber, or in embodiments comprising a plurality of optical fibers at least one of the optical fibers, may form a loop, returning to surface via the conveyance.

As described above, the sensing arrangement is disposed through the body of the valve device and extends beyond the valve device into the borehole.

The sensing arrangement may extend continuously from surface to the downhole location. The optical fiber, or in embodiments comprising a plurality of optical fibers at least one of the optical fibers, may for example extend continuously from surface to the downhole location.

The valve device may comprise or define a passage through which the sensing arrangement is disposed. The passage may be defined by or disposed in the body of the valve device.

In embodiments where the optical fiber or fibers extend continuously from surface to the downhole location, the optical fiber may extend through the passage of the valve device in order to reach the downhole location. The passage may comprise a bore extending through the body.

In particular embodiments, however, the valve device may comprise one or more optical fibers, the valve device optical fibers having optical connectors configured to interconnect optical fibers above and below the valve device, and thereby provide a continuous sensing arrangement from surface to the downhole location.

The valve device may be configured to engage the borehole, in particular a completion, completion string or the like disposed in the borehole.

In particular embodiments, the valve device may be configured to engage a subsurface safety valve of the completion string. Oil and gas wells feature multiple safety systems to prevent uncontrolled release of fluid from the formation, including the provision of one or more subsurface safety valves in the production tubing which carries the hydrocarbons to surface. A typical safety valve will be mounted inside the production tubing and will be controllable from surface via one or more hydraulic control lines mounted on the outside of the production tubing.

In use, once the valve device has engaged the subsurface safety valve, the subsurface safety valve can be maintained in an open configuration, well control being provided by the valve device of the apparatus.

Beneficially, embodiments of the present disclosure thus permit retrofit deployment into, and data acquisition and/or monitoring operations to be carried out in, pre-existing or mature wells without the requirement to modify the existing infrastructure.

The valve device may comprise a lock arrangement for securing the valve device to the borehole.

The lock arrangement may comprise a single lock member.

In particular embodiments, however, the lock arrangement may comprise a plurality of lock members. In particular embodiments, the lock member(s) may comprise dogs.

The lock member(s) may be radially extendable.

The radially extendable lock member(s) may engage a recess in the completion, for example a recess in the subsurface safety valve.

The lock arrangement may be activated from surface.

The lock arrangement may be activated from surface using a control line, for example but not exclusively a hydraulic control line. In particular embodiments, the control line for activating the lock arrangement may be disposed within, or form part of, the conveyance for conveying the valve device into the borehole.

The lock arrangement may be activatable by an operator at surface.

The lock arrangement may be activatable automatically on reaching a desired location in the borehole. For example, the lock arrangement may activate automatically when the valve device is disposed within the subsurface safety valve.

The valve device may comprise a sleeve. The sleeve may be axially moveable relative to the body. The sleeve may form part of the lock arrangement of the valve device. In use, axial movement of the sleeve may activate the lock arrangement of the valve device. For example, relative axial movement of the sleeve relative to the body may urge the lock member(s) radially outwards.

The sleeve may be biased by a spring.

As described above, the valve device comprises a valve member for permitting selective access through the axial flow passage. The valve member is moveable between an open position and a closed position, the valve device defining the open configuration when the valve member is in the open position and the valve device defining the closed configuration when the valve member is in the closed position.

In particular embodiments, the valve member of the valve device may comprise a flapper.

The valve device may comprise a sleeve for moving the valve member between the closed position and the open position.

The sleeve may be biased by a spring. Beneficially, the spring biases the valve member towards the closed position such that in the event of loss of power to the valve device the valve device will close and maintain well integrity.

The valve member may be actuated by a control line from surface, in particular but not exclusively a hydraulic control line. In particular embodiments, the valve member may be actuated by a control line operatively associated with the subsurface safety valve. Alternatively, the valve member may be actuated by a control line of the apparatus. The apparatus control line may be housed in or form part of the conveyance.

The valve device may comprise one or more seal. The seal may comprise a packer seal for preventing leakage of fluid between the valve device and the borehole/completion.

As described above, the apparatus comprises a conveyance for conveying the valve device into the borehole.

The conveyance may comprise braided line.

The conveyance may comprise slick line.

The apparatus may comprise or may be operatively associated with a hanger.

The hanger may be configured to support the apparatus in the borehole.

In particular embodiments, the hanger may be configured to support the apparatus within a spool.

The hanger may comprise a body and an axial flow passage.

The hanger may comprise a lock arrangement ("the hanger lock arrangement") for securing the hanger to the spool.

The hanger lock arrangement may comprise a single lock member or a plurality of lock members ("the hanger lock member(s)").

In particular embodiments, the hanger lock member(s) may comprise dogs.

The hanger lock member(s) may be radially extendable.

The radially extendable hanger lock member(s) may engage a recess in the spool.

The hanger may comprise a sleeve ("the hanger sleeve"). The hanger sleeve may be axially moveable relative to the body of the hanger. The hanger sleeve may form part of the hanger lock arrangement. In use, axial movement of the hanger sleeve may activate the hanger lock arrangement. For example, relative axial movement of the hanger sleeve relative to the body of the hanger may urge the hanger lock member(s) radially outwards.

The hanger sleeve may be biased by a spring.

The hanger may comprise one or more seal ("the hanger seal(s)"). The hanger seal(s) may comprise a packer seal for preventing leakage of fluid between the hanger and the spool.

The apparatus may comprise or may be operatively associated with the spool.

The spool may be located at the wellhead.

The spool may comprise a body and an axial throughbore.

The spool may comprise a no-go or landing nipple. The no-go or landing nipple may be formed as a bore restriction in the axial throughbore. Alternatively, the no-go or landing nipple may comprise a separate seat.

The spool may comprise a locking recess. In use, the hanger lock arrangement may engage the locking recess of the spool to secure the hanger in the spool.

The spool body may comprise one or more lateral bore for receiving the optical fiber or fibers of the apparatus.

The spool body may comprise one or more lateral bore for receiving the control line of the apparatus.

The apparatus may comprise or may be operatively associated with a fluid injection arrangement. In use, the fluid injection arrangement may be configured to inject fluid into the formation, for example but not exclusively in order to perform a chemical treatment.

The fluid injection arrangement may comprise a fluid injection line.

The valve device may comprise a connector for receiving the fluid injection line.

The valve device may comprise an injection fluid communication channel for communicating the fluid to be injected through the valve device. The injection fluid communication channel may be disposed in the body. The injection fluid communication channel may be isolated from the axial fluid passage of the valve device.

Beneficially, embodiments of the present disclosure may facilitate fluid injection operations to be carried out while maintaining full well control capability, since operation of the injection arrangement is unaffected by the configuration of the valve device; in contrast to conventional injection techniques and equipment which require the completion system safety control valve to be open in order to permit injection systems to be run into the borehole.

The fluid injection arrangement may comprise an injection valve, in particular but not exclusively a chemical injection valve.

The fluid injection arrangement may comprise an injection line for communicating the injection fluid from the valve device to the chemical injection valve.

The injection valve for communicating the injection fluid from the valve device to the chemical injection valve may comprise a capillary string. The injection valve for communicating the injection fluid from the valve device to the chemical injection valve may, for example be hung off the valve device.

As described above, the valve device may be run into a borehole, in particular an existing completion, completion string or the like, and may be operable to provide downhole data acquisition and/or monitoring in the borehole.

The apparatus may be provided in combination with, or form part of, the completion system.

According to a second aspect, there is provided a completion system comprising an apparatus according to the first aspect.

The completion system may comprise a valve, in particular but not exclusively a subsurface safety valve (SSV).

In particular embodiments, the valve may comprise a flapper valve.

The completion system may comprise a screen arrangement.

The screen arrangement may comprise a sand screen. The screen arrangement may comprise a single sand screen. However, in particular embodiments, the screen arrangement may comprise a plurality of screens.

The completion system may comprise a gauge.

The gauge may comprise a pressure gauge.

The gauge may comprise a temperature gauge.

In particular embodiments, the gauge may comprise a pressure and temperature (PIT) gauge.

The completion system may comprise a tubing hanger; such as a liner hanger.

The completion system may comprise an annulus seal device, such as a packer. In use, the annulus seal device may isolate the annulus above the tubing hanger to prevent passage of fluid up the annulus.

According to a third aspect, there is provided a method for downhole data acquisition and/or monitoring, the method comprising: providing an apparatus according to the first aspect in a borehole; and obtaining data using the sensing arrangement of the apparatus. The method may comprise the step of engaging the valve device with a valve in the borehole, in particular but not exclusively a subsurface safety valve of a completion, completion string or the like in the borehole.

The method may comprise engaging a hanger operatively associated with, or forming part of, the apparatus with a wellhead spool.

Embodiments of the present disclosure provide a number of benefits.

For example, embodiments of the present disclosure may facilitate downhole data acquisition and/or monitoring while maintaining full well control capability, since operation of the sensing arrangement is unaffected by the configuration of the valve device; in contrast to conventional data acquisition and/or monitoring techniques which require the completion system safety control valve to be open in order to permit monitoring systems to be run into the borehole.

Embodiments of the present disclosure may permit data acquisition relating to a formation and/or reservoir at a downhole location or locations—e.g. at the point of injection of a chemical treatment—which is otherwise not possible with conventional techniques and equipment.

The data may be obtained in real time, permitting an operator to improve the efficiency and/or efficacy of an intervention operation—e.g. by permitting an operator to optimize the quantity and/or composition of treatment fluid in a chemical treatment.

Embodiments of the present disclosure provide a retrofittable permanent or semi-permanent system for oil and gas reservoir monitoring. Embodiments of the present disclosure may thus be maintained in place during subsequent operations, reducing downtime which may be otherwise be associated with conventional techniques requiring data acquisition runs into the borehole.

It should be understood that the features defined above or described below may be utilized, either alone or in combination with any other defined or described feature.

BRIEF DESCRIPTION OF THE DRAWINGS

These and other aspects of the present disclosure will now be described by way of example only with reference to the accompanying drawings, in which.

DETAILED DESCRIPTION OF THE DRAWINGS

Figure 1:
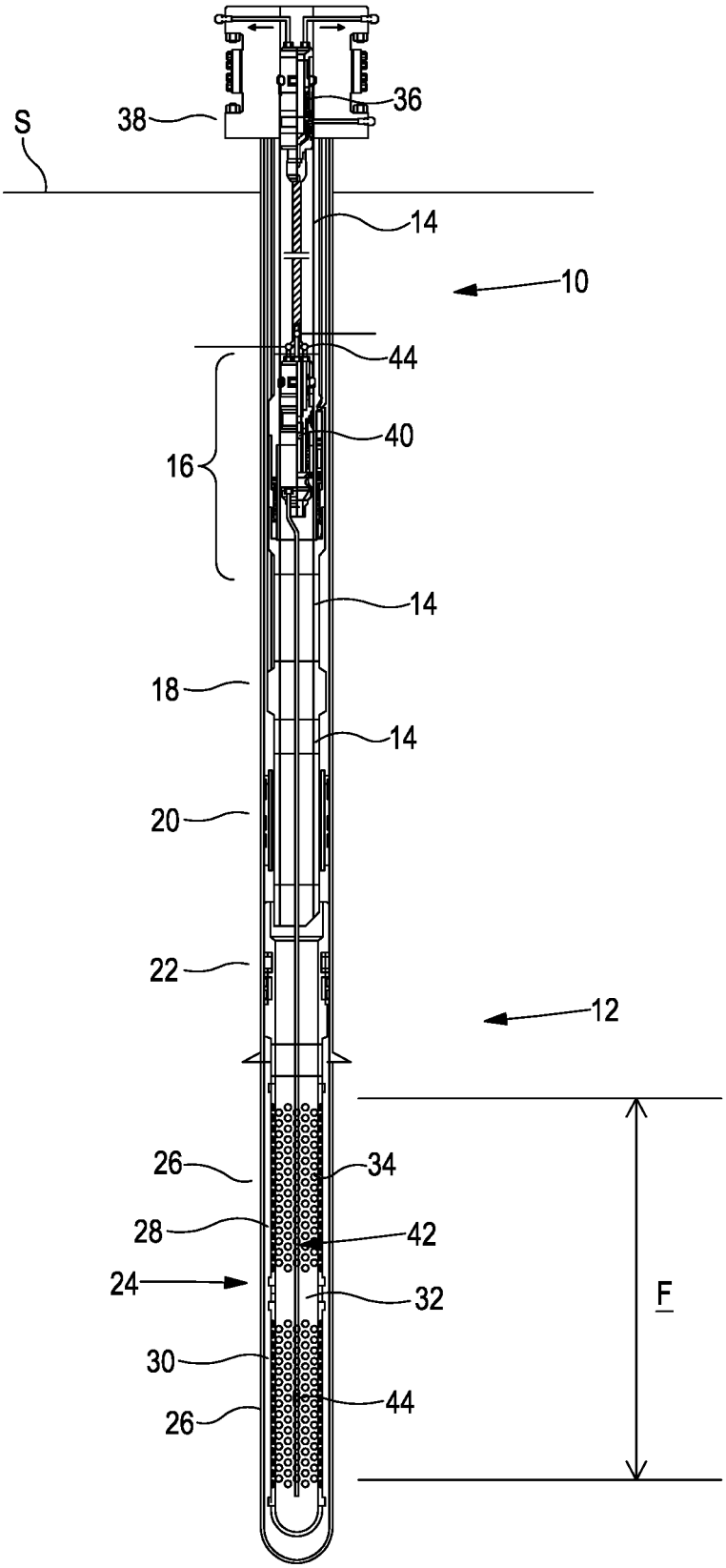
FIG. 1 shows a completion system including an apparatus according to an embodiment of the present disclosure.

FIG. 1 of the accompanying drawings shows an apparatus 10 for downhole data acquisition and/or monitoring according to a first embodiment of the present disclosure. In use, the apparatus 10 is configured to be disposed within an existing completion 12 and is operable to provide data relating to the formation F, in particular but not exclusively data acquisition in the region where a fluid injection operation has been, or is to be, carried out.

As shown in FIG. 1, the completion 12 comprises a string of connected sections of production tubing 14 and a number of downhole tools, including in the illustrated embodiment a subsurface safety valve 16, a pressure/temperature (PT) gauge 18, a production packer 20, and a liner hanger 22 supporting a sand screen arrangement 24. In the illustrated embodiment, the completion 12 comprises two sand screens 26, although it will be understood that the completion 12 may comprise any number of sand screens 26. Annulus 28 surrounding the sand screen arrangement 24 has been packed, e.g. with gravel 30, to prevent or at least mitigate ingress of particulate matter into the completion 12.

As can be seen from FIG. 1, the completion 12 forms an axial flow passage 32 from the formation F to surface S and, in use, hydrocarbons from the formation F enter the completion 12 via perforations 34 in the sand screens 26 and pass to surface S via the axial flow passage 32.

As described above, production of hydrocarbons from a given formation, such as the formation F shown in FIG. 1, will typically vary over the operational life of a well and it may be necessary or desirable to perform an intervention operation or workover operation in order to stimulate or in some cases re-establish production from the formation F. One such intervention operation used to stimulate production in the event of excessive water ingress ("liquid loading") involves a chemical treatment whereby a foaming agent is injected into the formation F.

As shown in FIG. 1, the apparatus 10 is configured to be disposed within the completion 12 and comprises a hanger 36 configured to latch into a control line spool 38, a retrofit valve 40 for location within the subsurface safety valve 16 of the completion 12, and a sensing arrangement—represented generally by 42—including an optical fiber line 44.

In use, the apparatus 10 is configured to be run into the completion 12 and is operable to provide data acquisition and/or monitoring capability in the well, including up or near total depth and in particular but not exclusively in the region of the well subjected to an intervention operation, such as a chemical injection operation.

Figure 2:
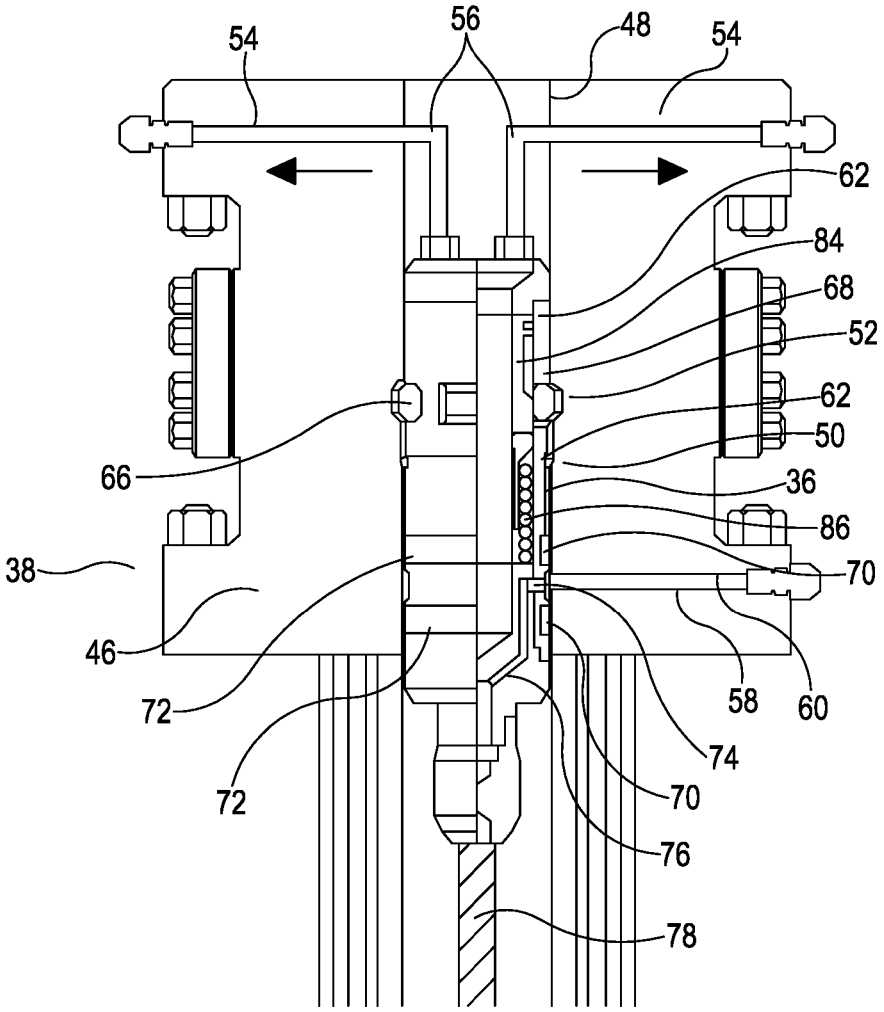
FIG. 2 shows an enlarged view of a hanger of the apparatus shown in FIG. 1.

FIG. 2 shows an enlarged view of the hanger 36 shown in FIG. 1, the hanger 36 shown engaged with the spool 38.

As shown in FIG. 2, the spool 38 has a body 46 having an axial throughbore 48. A bore restriction in the form of no-go or landing nipple 50 is formed in the axial throughbore 48 of the spool 38. A locking recess 52 is formed in the spool 38 and in the illustrated embodiment the locking recess 52 is disposed uphole of the landing nipple 50. Lateral bores 54 are provided in the body 46 for receiving optical fiber lines 56. Lateral bore 58 is provided in the body 46 for receiving a control line 60, which in the illustrated embodiment takes the form of a hydraulic control line.

The hanger 36 comprises a body 62 having a shoulder 64 for engaging the landing nipple 50 of the spool 38. A number of circumferentially arranged dogs 66 are disposed in pockets 68 formed in the body 62. Packer seals 70 are disposed in respective grooves 72 and straddle a lateral port 74. In use, when the shoulder 64 of the hanger 36 lands on the landing nipple 50 of the spool 38, the lateral port 74 communicates with control line 60.

Figure 3:
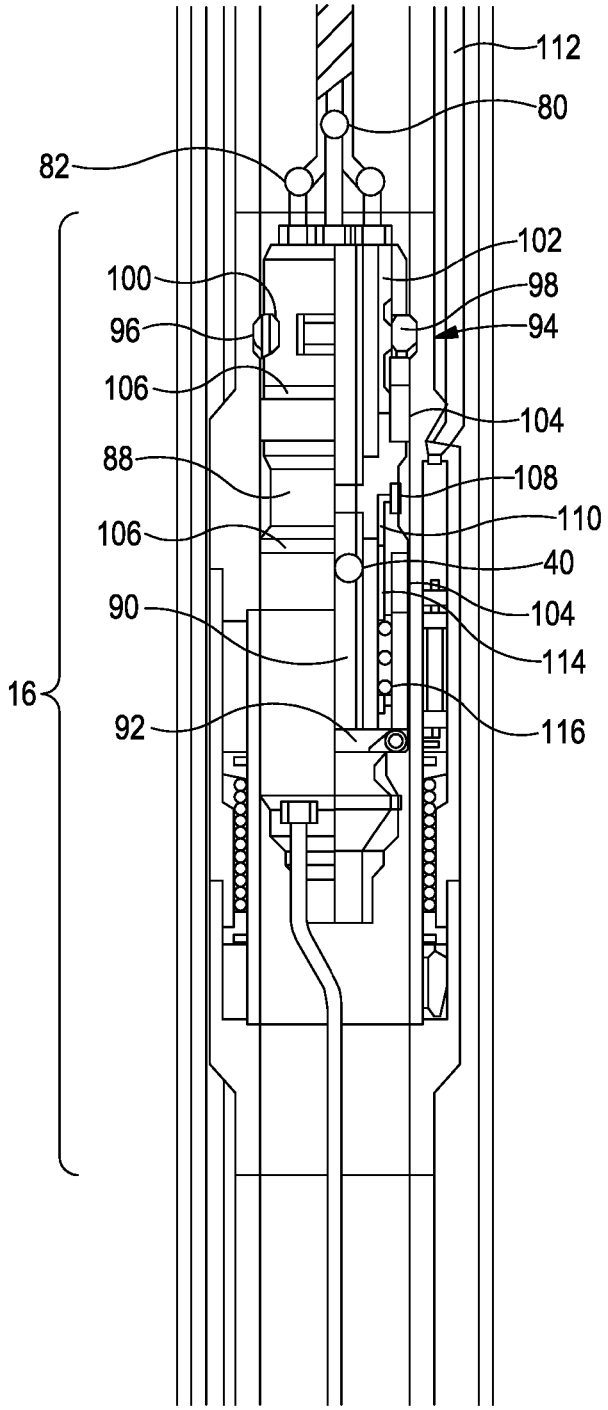
FIG. 3 shows an enlarged view of a retrofit valve device of the apparatus shown in FIG. 1.

The body 62 comprises a fluid conduit 76 for communicating fluid from the control line 60 to braided line 78 which includes a hydraulic control line 80 and an optical fiber line 82 (shown in FIG. 3).

A sleeve 84—biased by spring 86—is disposed within and axially moveable relative to the body 62, In use, movement of the sleeve 84 urges the dogs 66 radially outwards into engagement with the locking recess 52. The spring 86 biases the sleeve 84 to the position shown in FIG. 2 which supports the dogs 66 in their radially extended position.

FIG. 3 of the accompanying drawings shows an enlarged view of the retrofit valve 40 shown in FIG. 1. The retrofit valve 40 has a body 88, an axial flow passage 90 and a valve member 92 which in the illustrated embodiment comprises a flapper moveable between an open position in which the valve member 92 permits passage of fluid through the axial flow passage 90 and a closed position (as shown in FIG. 3) in which the valve member 92 closes the axial flow passage 90.

The retrofit valve 40 is configured to be run into the subsurface safety valve 16 of the completion 12, a lock arrangement 94 of the valve 40 operable to secure retrofit valve 40 to a locking recess 96 provided in the subsurface safety valve 16 as will be described below. In the illustrated embodiment, the lock arrangement 94 of the retrofit valve 40 comprises a number of circumferentially arranged dogs 98 disposed in pockets 100 formed in the body 88. A sleeve 102 is disposed within and axially moveable relative to the body 88. In use, movement of the sleeve 102 urges the dogs 98 radially outwards into engagement with the locking recess 96 to support the retrofit valve 40 within the subsurface safety valve 16.

As shown in FIG. 3, packer seals 104 are disposed in respective grooves 106, the packer seals 104 preventing leakage of fluid between the retrofit valve 40 and the subsurface safety valve 16. The packer seals 104 also form part of an activation arrangement for the valve member 92 since, in use, when the lock arrangement 94 engages the locking recess 96, the packer seals 104 straddle a port 108 provided in the body 88 which communicates, via conduit 110, with a control line 112 associated with the subsurface safety valve 16. Beneficially, this permits the valve member 92 of the retrofit valve 40 to be operated using existing control infrastructure.

As shown in FIG. 3, the port 110 communicates with a sleeve 114—biased by spring 116—which is disposed within and axially moveable relative to the body 88. In use, pressure applied via control line 112 moves the sleeve 114 axially relative to the body 88 which in turn moves the valve member 92 to the open position. Beneficially, the spring 116 biases the valve member 92 towards the closed position such that in the event of loss of power to the valve 40 the valve 40 will close and maintain well integrity.

In use, once the valve 40 has engaged the subsurface safety valve 16, the subsurface safety valve 16 can be maintained in an open configuration, well control being provided by the valve 40.

Beneficially, embodiments of the present disclosure thus permit retrofit deployment into, and data acquisition and/or monitoring operations to be carried out in, pre-existing or mature wells without the requirement to modify the existing infrastructure.

As described above, the apparatus 10 comprises a sensing arrangement 42 including an optical fiber line 44 and in the illustrated embodiment the valve 40 has optical connectors configured to interconnect optical fibers above and below the valve 40, thereby providing a continuous sensing arrangement from surface to the downhole location.

Figure 4:
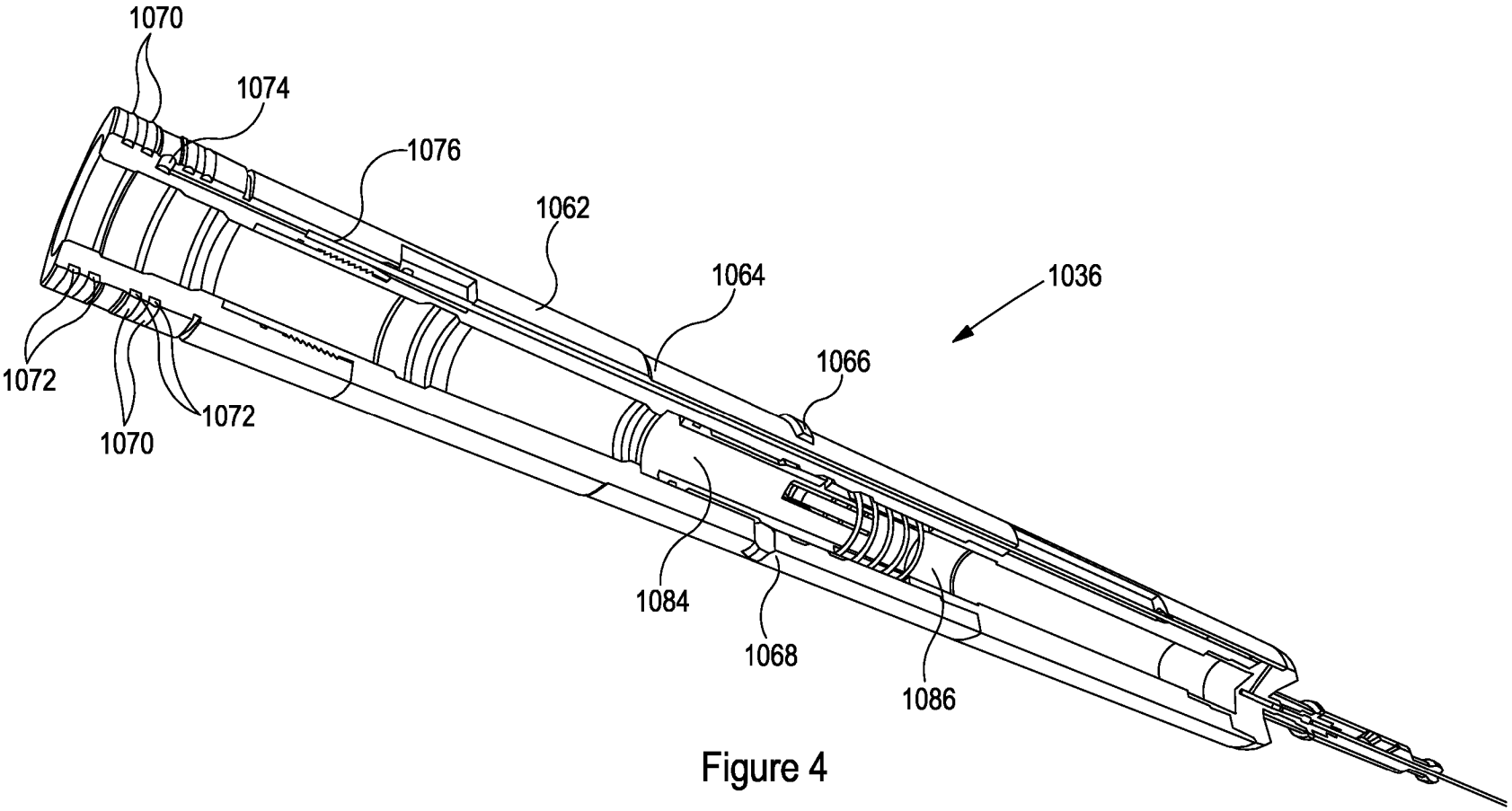
FIG. 4 shows a perspective cut-away view of an exemplary hanger for use in embodiments of the present disclosure.

FIG. 4 of the accompanying drawings shows a hanger 1036 for use in embodiments of the present disclosure.

The hanger 1036 comprises a body 1062 having a shoulder 1064 for engaging the landing nipple 50 of the spool 38 (shown in FIG. 3). A number of circumferentially arranged dogs 1066 are disposed in pockets 1068 formed in the body 1062. Packer seals 1070 are disposed in respective grooves 1072 and straddle a lateral port 1074. In use, when the shoulder 1064 of the hanger 1036 lands on the landing nipple 50 of the spool 38, the lateral port 1074 communicates with control line 60.

The body 1062 comprises a fluid conduit 1076 for communicating fluid from the control line 60 to braided line 78. A sleeve 1084—biased by spring 1086—is disposed within and axially moveable relative to the body 1062. In use, movement of the sleeve 1084 urges the dogs 1066 radially outwards into engagement with the locking recess 52. The spring 1086 biases the sleeve 1084 to the position shown in FIG. 2 which supports the dogs 1066 in their radially extended position.

Figure 5:
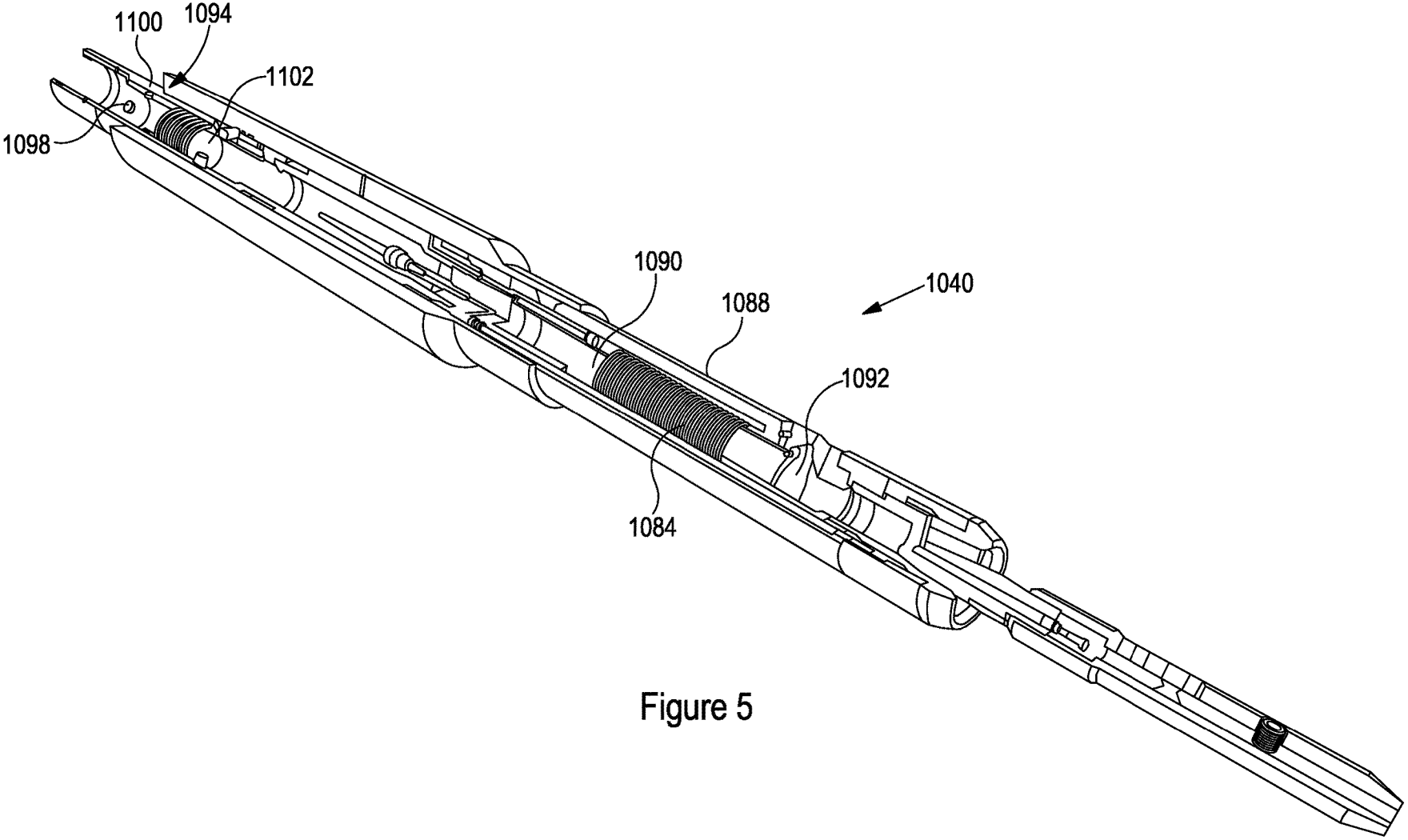
FIG. 5 shows a perspective cut-away view of a retrofit valve for use in embodiments of the present disclosure.
Figure 6:
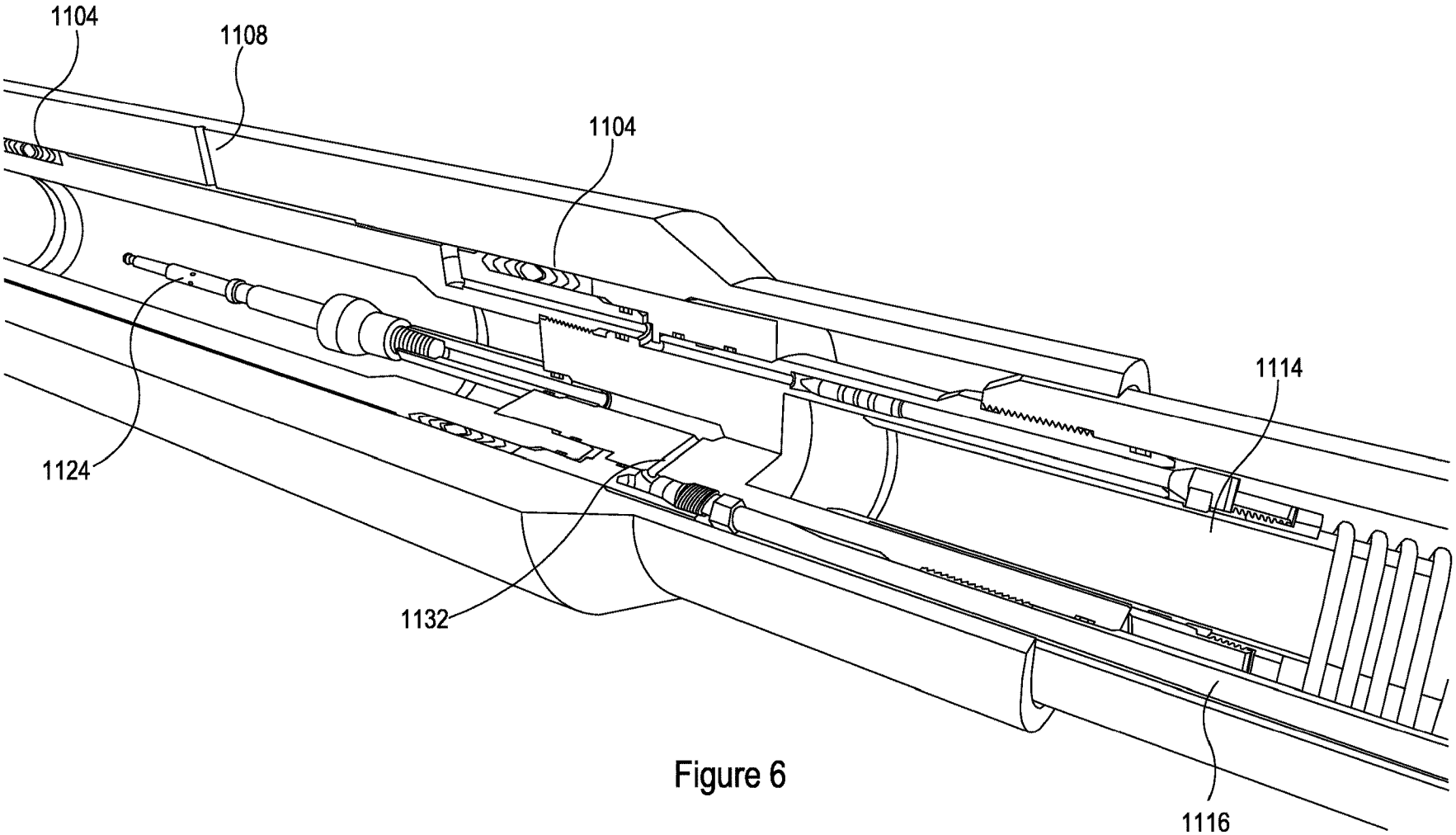
FIG. 6 shows an enlarged view of part of the retrofit valve shown in FIG. 5.
Figure 7:
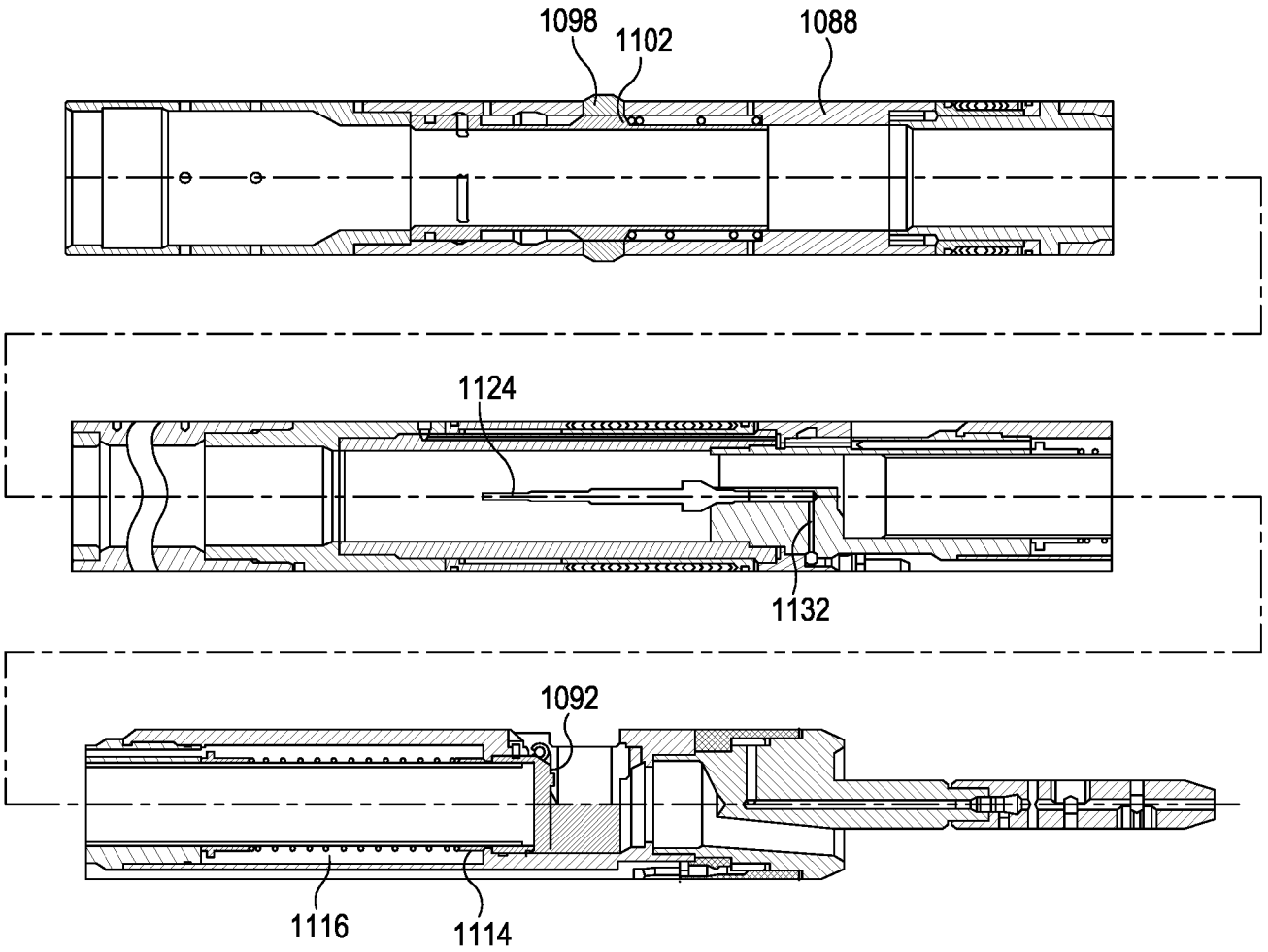
FIG. 7 shows a longitudinal section view of the retrofit valve shown in FIG. 5.

FIGS. 5, 6 and 7 show a retrofit valve 1040 for use in embodiments of the present disclosure.

The retrofit valve 1040 has a body 1088, an axial flow passage 1090 and a valve member 1092 which in the illustrated embodiment comprises a flapper moveable between an open position in which the valve member 1092 permits passage of fluid through the axial flow passage 1090 and a closed position (as shown in FIG. 5) in which the valve member 1092 closes the axial flow passage 1090.

The retrofit valve 1040 is configured to be run into the subsurface safety valve 16 of the completion 12, a lock arrangement 1094 operable to secure retrofit valve 1040 to a locking recess 96 provided in the subsurface safety valve 16 as will be described below. In the illustrated embodiment, the lock arrangement 1094 of the retrofit valve 1040 comprises a number of circumferentially arranged dogs 1098 disposed in pockets 1100 formed in the body 1088. A sleeve 1102 is disposed within and axially moveable relative to the body 1088. In use, movement of the sleeve 1102 urges the dogs 1098 radially outwards into engagement with the locking recess 96 to support the retrofit valve 1040 within the subsurface safety valve 16.

Packer seals 1104 are provided to prevent leakage of fluid between the retrofit valve 1040 and the subsurface safety valve 16. The packer seals 1104 also form part of an activation arrangement for the valve member 1092 since, in use, when the lock arrangement 1094 engages the locking recess 1096, the packer seals 1104 straddle a port 1108 provided in the body 1088 which communicates with the control line 112 associated with the subsurface safety valve 16. Beneficially, this permits the valve member 1092 of the retrofit valve 1040 to be operated using existing control infrastructure.

The port 1108 communicates with a sleeve 1114—biased by spring 1116—which is disposed within and axially moveable relative to the body 1088. In use, pressure applied via control line 112 moves the sleeve 1114 axially relative to the body 1088 which in turn moves the valve member 1092 to the open position. Beneficially, the spring 1116 biases the valve member 1092 towards the closed position such that in the event of loss of power to the valve 1040 the valve 1040 will close and maintain well integrity.

Figure 8:
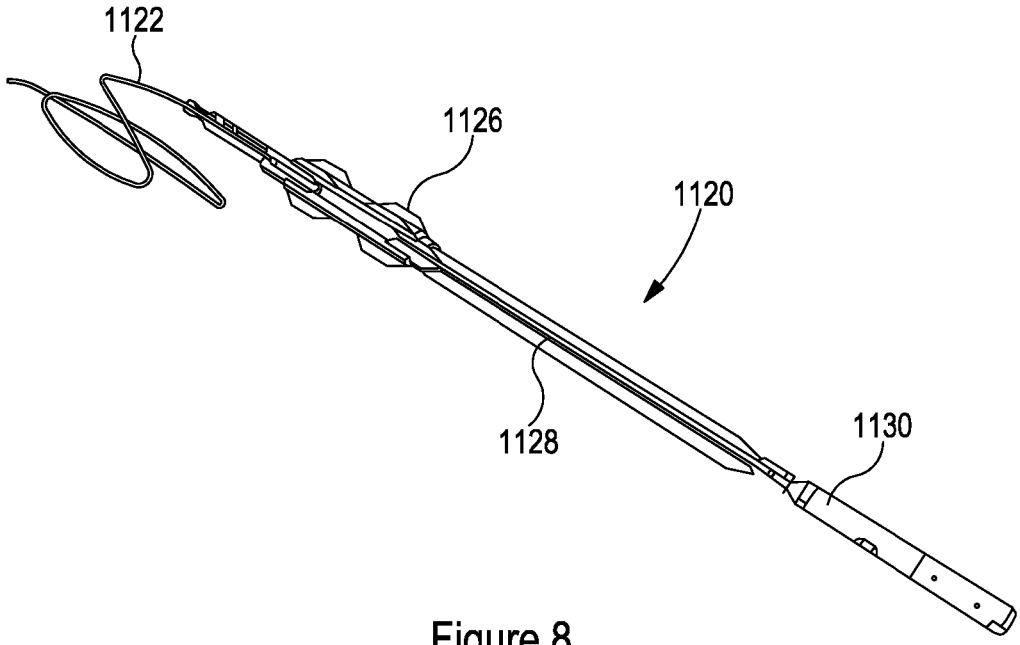
FIG. 8 shows a perspective cut-away view of an injection arrangement according to an embodiment of the present disclosure.
Figure 9:
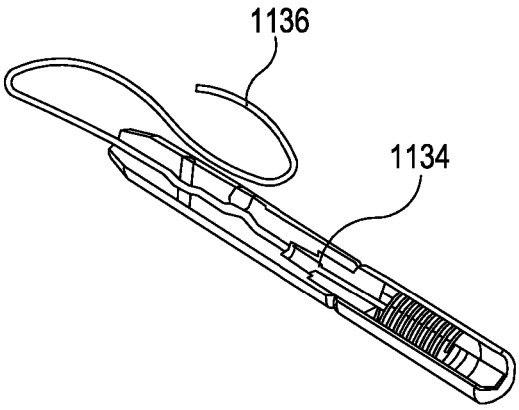
FIG. 9 shows a perspective cut-away view of an injection valve.

Referring now also FIGS. 8 and 9 of the accompanying drawings, the apparatus 1010 comprises a fluid injection arrangement 1120 configured to inject fluid into the formation F, for example but not exclusively in order to perform a chemical treatment.

In the illustrated embodiment, the fluid injection arrangement 1120 comprises a fluid injection line 1122 configured to engage a connector 1124 (shown in FIGS. 6 and 7) on the retrofit valve 1040. The fluid injection arrangement 1120 further comprises a centraliser 1126, a weight bar 1128 and a quick connect connector 1130 for coupling to the connector 1124.

As shown in FIGS. 6 and 7 for example, the valve 1140 comprises an injection fluid communication channel 1132 for communicating the fluid to be injected through the valve 1040.

As shown in FIG. 9, the fluid injection arrangement 1120 comprises an injection valve 1134, which in the illustrated embodiment takes the form of a chemical injection valve.

An injection line 1136, which in the illustrated embodiment takes the form of a capillary string, is provided for communicating the injection fluid from the valve 1040 to the injection valve 1134.

Embodiments of the present disclosure may thus facilitate fluid injection operations to be carried out while maintaining full well control capability, since operation of the injection arrangement 1120 is unaffected by the configuration of the valve 1040; in contrast to conventional injection techniques and equipment which require the completion system safety control valve to be open in order to permit injection systems to be run into the borehole.

It will be apparent to those of skill in the art that the above-described embodiments are merely exemplary of the present disclosure and that various modifications and improvements may be made thereto without departing from the scope of the present disclosure.

Figure 10:
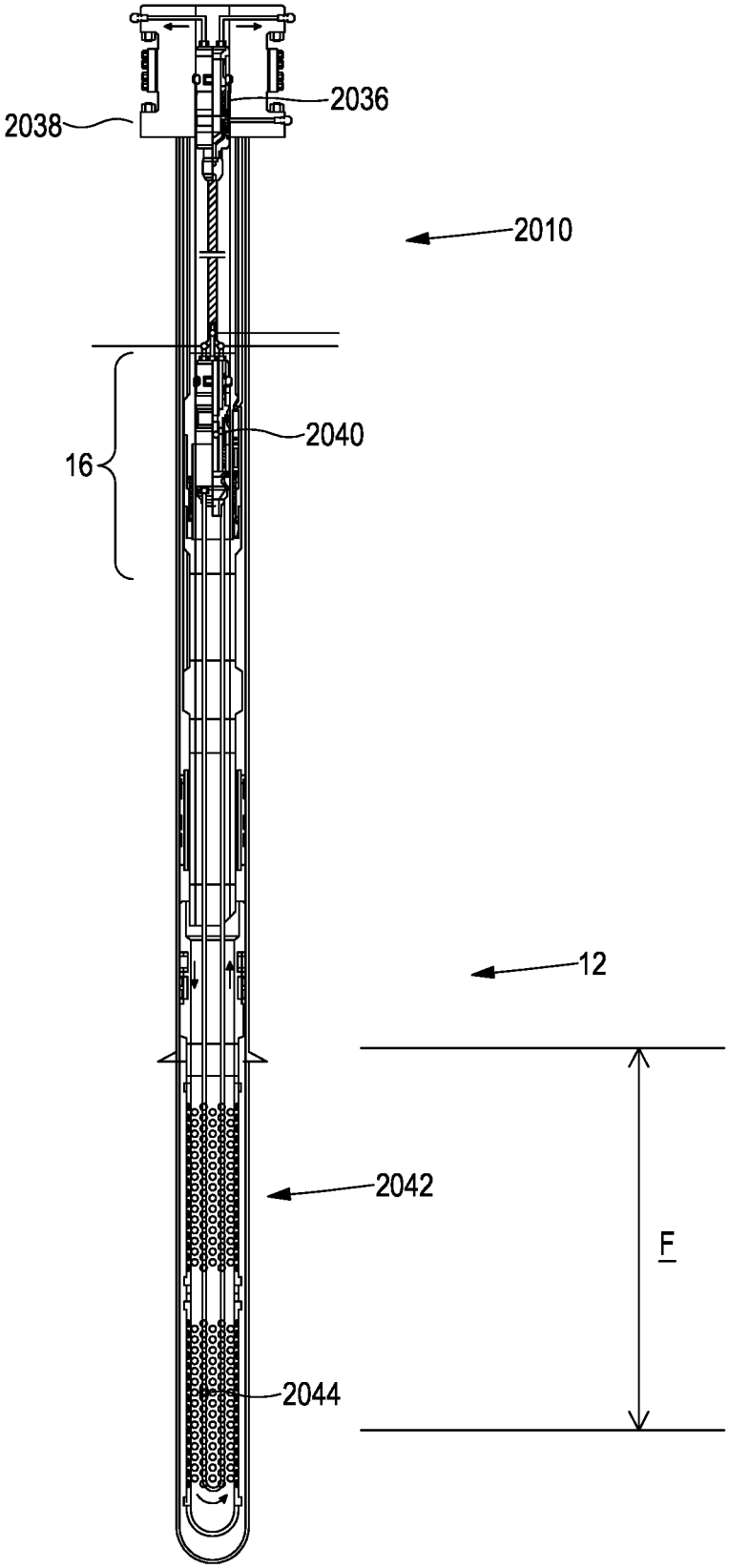
FIG. 10 shows a completion system including an apparatus according to a second embodiment of the present disclosure.

FIG. 10 shows an apparatus 2010 according to a second embodiment of the present disclosure. The apparatus 2010 is similar to the apparatus 10 and like components are represented by like numerals incremented by 2000.

Apparatus 2010 is configured to be disposed within an existing completion 12 and is operable to provide data relating to the formation F, in particular but not exclusively data acquisition in the region where a fluid injection operation has been, or is to be, carried out.

As shown in FIG. 10, the apparatus 2010 is configured to be disposed within the completion 12 and comprises a hanger 2036 configured to latch into a control line spool 2038, a retrofit valve 2040 for location within the subsurface safety valve 16 of the completion 12, and a sensing arrangement 2042 including an optical fiber line 2044. In this embodiment, however, the optical fiber line 2044 comprises a loop.

In use, the apparatus 2010 is configured to be run into the completion 12 and is operable to provide data acquisition and/or monitoring capability in the well, including up or near total depth and in particular but not exclusively in the region of the well subjected to an intervention operation, such as a chemical injection operation.

The invention claimed is:

1. An apparatus for downhole data acquisition and/or monitoring, the apparatus comprising:

a valve device adapted to be run into a borehole, the valve device comprising:

a body;

an axial flow passage; and a valve member for permitting selective access through the axial flow passage of the valve device, wherein the valve device is configurable between an open configuration in which the valve member permits passage of fluid through the axial flow passage of the valve device and a closed configuration;

a conveyance for conveying the valve device into and/or from the borehole, the conveyance comprising a sensing arrangement including an optical fiber for providing downhole data acquisition and/or monitoring in the borehole, wherein the sensing arrangement is disposed through the body of the valve device and extends beyond the valve device into the borehole; and a hanger configured to support the apparatus within a spool located at a wellhead, the hanger comprising a lock arrangement for securing the hanger to the spool so as to support the apparatus within the spool.

2. The apparatus of claim 1, wherein the optical fiber forms a loop.

3. The apparatus of claim 1, wherein the sensing arrangement comprises a plurality of the optical fiber.

4. The apparatus of claim 1, wherein the sensing arrangement extends continuously from surface to the downhole location.

5. The apparatus of claim 1, wherein the valve device comprises one of more valve device optical fibers having optical connectors configured to interconnect other optical fibers above and below the valve device.

6. The apparatus of claim 1, wherein the body of the valve device comprises or defines a passage through which the sensing arrangement is disposed, the passage isolated from the axial flow passage of the valve device.

7. The apparatus of claim 1, wherein the valve device is configured to engage a valve in the borehole.

8. The apparatus of claim 1, wherein the valve device comprises a lock arrangement for securing the valve device to the borehole.

9. The apparatus of claim 8, wherein at least one of:

the lock arrangement of the valve device is activatable from surface using a control line; and the lock arrangement of the valve device is activatable automatically on reaching a desired location in the borehole.

10. The apparatus of claim 1, comprising or operatively associated with the spool.

11. The apparatus of claim 1, comprising or operatively associated with a fluid injection arrangement.

12. The apparatus of claim 11, wherein the fluid injection arrangement comprises at least one of:

a fluid injection line; and an injection fluid communication channel disposed in the body of the valve device for communicating fluid to be injected through the valve device, the injection fluid communication channel isolated from the axial fluid passage of the valve device.

13. The apparatus of claim 11, wherein the fluid injection arrangement comprises an injection valve.

14. The apparatus of claim 1, wherein the lock arrangement of the hanger comprises one or more radially extendable lock members.

15. The apparatus of claim 1, wherein the hanger comprises a sleeve, the sleeve being axially moveable to activate the lock arrangement of the hanger.

16. The apparatus of claim 2, wherein the loop returns to surface via the conveyance.

17. The apparatus of claim 10, wherein the spool comprises at least one of:

a no-go or landing nipple; and a locking recess for engagement with the lock arrangement of the hanger to secure the hanger in the spool.

18. A completion system comprising the apparatus according to claim 1.

19. A method for downhole data acquisition and/or monitoring, the method comprising:

providing an apparatus according to claim 1 in a borehole; and obtaining data using the sensing arrangement of the apparatus.

20. The method of claim 19, comprising engaging the valve device with a valve in the borehole.

* * * * *